US008371539B2

(12) United States Patent
Hirota et al.

(10) Patent No.: US 8,371,539 B2
(45) Date of Patent: Feb. 12, 2013

(54) REMOTE CONTROL RETAINER

(75) Inventors: Hideyuki Hirota, Tokyo (JP); Takahiro Ikunami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 617 days.

(21) Appl. No.: 12/599,551

(22) PCT Filed: Apr. 4, 2008

(86) PCT No.: PCT/JP2008/000880

§ 371 (c)(1),
(2), (4) Date: Nov. 10, 2009

(87) PCT Pub. No.: WO2009/008116

PCT Pub. Date: Jan. 15, 2009

(65) Prior Publication Data

US 2011/0158743 A1 Jun. 30, 2011

(30) Foreign Application Priority Data

Jul. 6, 2007 (JP) ..... 2007-178784

(51) Int. Cl.
*G12B 9/00* (2006.01)

(52) U.S. Cl. ..... 248/27.1; 296/37.7; 292/80; 292/81; 292/87; 292/89

(58) Field of Classification Search ..... 248/27.1, 248/510, 902, 312.1, 309.1; 296/37.7; 348/734; 292/1, 80, 81, 87, 89, 194, 195, 198, 202, 292/219, 220, 228; 312/319.2; 16/267; 220/529, 220/531

See application file for complete search history.

(56) References Cited

U.S. PATENT DOCUMENTS

| | | | | | |
|---|---|---|---|---|---|
| 4,469,365 | A | * | 9/1984 | Marcus et al. | 296/37.7 |
| 4,630,794 | A | * | 12/1986 | Ross | 248/309.1 |
| 4,867,498 | A | * | 9/1989 | Delphia et al. | 296/37.7 |
| 5,146,650 | A | * | 9/1992 | Robertson | 16/259 |
| 5,374,103 | A | * | 12/1994 | Stange et al. | 297/188.16 |
| 5,388,880 | A | * | 2/1995 | Kinane | 296/37.7 |
| 5,522,638 | A | * | 6/1996 | Falcoff et al. | 296/37.8 |
| 5,823,495 | A | * | 10/1998 | Joss et al. | 248/309.1 |
| 6,000,768 | A | * | 12/1999 | Dials et al. | 312/223.2 |
| 6,003,925 | A | * | 12/1999 | Litke et al. | 296/37.8 |

(Continued)

FOREIGN PATENT DOCUMENTS

| | | |
|---|---|---|
| JP | 59-17675 U | 2/1984 |
| JP | 2-146165 A | 6/1990 |

(Continued)

*Primary Examiner* — Terrell McKinnon
*Assistant Examiner* — Michael McDuffie
(74) *Attorney, Agent, or Firm* — Birch, Stewart, Kolasch & Birch, LLP

(57) ABSTRACT

A shaft 14 is provided on the opposite side of the side provided with a locking mechanism 7 in a remote control; a remote control holder 3 has provided thereon a bearing section 15 abutting on the shaft 14 when the remote control 1 is housed in the remote control holder 3; the remote control holder 3 further has supportingly provided thereon a holding lever 18 gripping the shaft 14 in cooperation with the bearing section 15; the holding lever 18 has provided thereon a coil spring 21 energizing the holding lever 18 toward the shaft 14; and further the remote control 1 has provided thereon a lever engaging section 23 that rotates the holding lever 18 against the resilient force of the coil spring when the remote control 1 is rotated to take out the remote control.

2 Claims, 3 Drawing Sheets

U.S. PATENT DOCUMENTS 6,116,675 A * 9/2000 Iwasawa ..... 296/37.8
6,126,221 A * 10/2000 Kern ..... 296/37.7
6,135,528 A * 10/2000 Sobieski et al. ..... 296/37.7
6,216,930 B1 * 4/2001 Plocher et al. ..... 224/539
6,234,570 B1 * 5/2001 Quinno et al. ..... 296/214
7,219,943 B2 * 5/2007 Shiomiya ..... 296/37.7
7,654,622 B2 * 2/2010 Nutt et al. ..... 312/223.6
7,661,741 B2 * 2/2010 Takai ..... 296/37.1
8,157,314 B2 * 4/2012 Gwon ..... 296/37.7
2005/0236857 A1 10/2005 Shiomiya
2006/0288532 A1 * 12/2006 Kim ..... 16/267

FOREIGN PATENT DOCUMENTS

JP 6-292283 A 10/1994
JP 7-96798 A 4/1995

* cited by examiner

REMOTE CONTROL RETAINER

TECHNICAL FIELD

The present invention relates to an apparatus housing and retaining a remote control.

BACKGROUND ART

Nowadays, a variety of appliances have a remote control (abbreviated to "remocon"). A remote control is used separately from an appliance main body thereof, and thus whereabouts of the remote control are sometimes not known. Particularly, the remote control of an on-vehicle appliance (a TV set, a DVD player, or the like used for a rear seat occupant), mounted on an automobile, sometimes also serves as the operation panel of the appliance in itself, and thus when the remote control is lost, the appliance cannot be operated. For this reason, some on-vehicle appliances have a mechanism where a remote control is assembled or incorporated to the part of the appliance main body, the remote control is separated from the main body when in use, and it is assembled to and held in the main body when not in use.

In the mechanism where a remote control is thus assembled to an appliance main body, it is desirable that the remote control can be held so as not to be dislodged by vehicle vibration under a condition where the remote control is assembled to the main body, and otherwise the remote control can be easily detached therefrom when it is used.

FIG. 4 and FIG. 5 illustrate an example of a conventional structure where a remote control is held by an apparatus main body. A remote control 101 is held by a concave remote control holder 102 provided on the side of an apparatus main body. The remote control 101 has stopper holes 103 provided on one side thereof, and stopper pins 104 engage in the respective stopper holes 103. The stopper pin 104 is extruded from the stopper hole 103 by pushing a release button 105. The remote control 101 has an engaging hole 106 provided at each end thereof, and engaging pins 108 each energized with resilient force by a coil spring 107 are engaged in the respective engaging holes 106. To be specific, the remote control 101 is held as it is pinched from both ends thereof between the engaging pins 108.

In that remote control holding mechanism, when the release button 105 is pushed to extrude the stopper pin 104 from the stopper hole 103, the remote control 101 is rotated about the engaging pins 108. After that, the remote control 101 is pulled, the engaging pins 108 are thereby pressed to be retracted by an engagement between the engaging hole 106 and the engaging pin 108 corresponding thereto, and then the remote control 101 becomes dislodged from the engaging pins 108. Since the remote control 101 should be moved perpendicularly with respect to the engaging pin 108 in order to remove the remote control 101 therefrom, the engaging pin 108 is arranged to have an inclined shape.

In this connection, as another example of a conventional remote control holding structure, Patent Document 1 discloses a structure where a resilient pawl engages in a concavity provided in the side of a remote control and the pawl is opened to release the retention of the remote control.

Patent Document 1: JP-A-06-292283

In the conventional remote control holding mechanism shown in FIG. 4 and FIG. 5, a detaching direction of the remote control 101 and a direction where a force is exerted on the remote control by the engaging pins 108 (or a sliding direction of each of the engaging pins) are different (perpendicular to each other), and thus the resisting force produced when the remote control 101 is detached is determined by the shape of the tip of the engaging pin 108. Further, the remote control 101 sometimes comes near to one of the engaging pins 108, and thus the amount of a load imposed on one side of the remote control by the engaging pin 108 can be different from that imposed on the other side thereof. At that time, the force required when the remote control 101 is detached becomes unbalanced on right and left sides. In other words, adjusting the force of holding the remote control 101 by using the resilient force of the coil springs 107 exerted on the engaging pins 108 is very difficult, and further a detaching property of the remote control 101 cannot also be stabilized by adjusting the resilient force alone.

Note that in the holding mechanism of the holder disclosed in Patent Document 1, the remote control is inserted therein and extracted therefrom vertically with respect to the case of the remote control, and thus it is difficult to apply the mechanism to an on-vehicle appliance such as an appliance secured to the ceiling of a vehicle. In other words, dislodgement of the pawl from the concavity places the remote control in a state where the remote control falls off. When the mechanism is substantially horizontally provided along the ceiling surface, there is the possibility that the remote control easily falls from the ceiling by the vibration of a vehicle.

The present invention has been made to solve the above-described problems, and an object of the present invention is to provide a remote control retainer eliminating the necessities of providing an engaging pin having a complicated shape and of adjusting the resilient force involved therein.

DISCLOSURE OF THE INVENTION

The remote control retainer according to the present invention is provided between a remote control and a remote control holder housing the remote control, and includes a locking means which is provided between one side of the remote control and the remote control holder and locks or unlocks the remote control with respect to the remote control holder; a shaft provided in the remote control on the side opposite the side where the locking means is provided; a bearing section which is provided on the side of the remote control holder and against which the shaft is abutted when the remote control is housed in the remote control holder; a lever gripping the shaft in cooperation with the bearing section; a spring member providing a holding force with which the shaft is pressed to the side of the bearing section to be held thereon to the lever; and a lever engaging section which is provided on the remote control, and when the locking means is released to rotate the remote control about the shaft, engages with the lever to rotate the lever against the resilient force of the spring member, thus moving the lever away from the shaft.

According to the remote control retainer of the present invention, in a state where the locking means is released, the remote control has the shaft gripped between the bearing section and the lever of the remote control holder, and thus the remote control stays in a temporarily retained state where the remote control does not fall off and is retained. When the remote control is rotated about its shaft, the lever engaging section of the remote control presses the lever to rotate the lever and move the lever away from the shaft. Specifically, the lever is rotated by the principle of leverage, and thus the remote control can be easily detached by a small force. Further, a detaching direction of the remote control and a moving direction of the holding lever are the same, and thus adjustment of the retaining force by the holding lever is easily made by adjusting the resilient force of the spring member exerted on the holding lever.

BEST MODE FOR CARRYING OUT THE INVENTION

Embodiments of the present invention will now be described with reference to the accompanying drawings in order to explain the present invention in more detail.

First Embodiment

Figure 1:
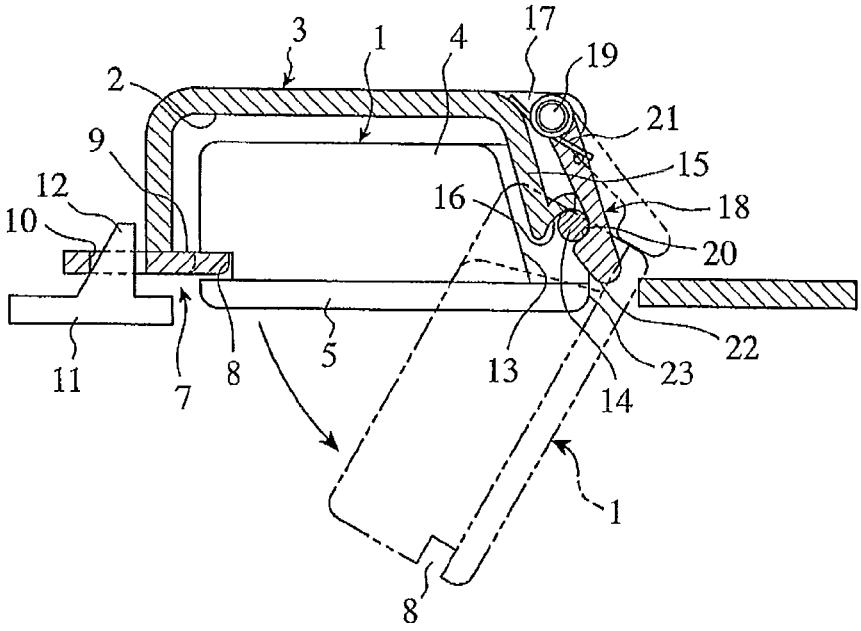
FIG. 1 is a sectional view of a remote control retainer in accordance with the first embodiment of the present invention.
Figure 2:
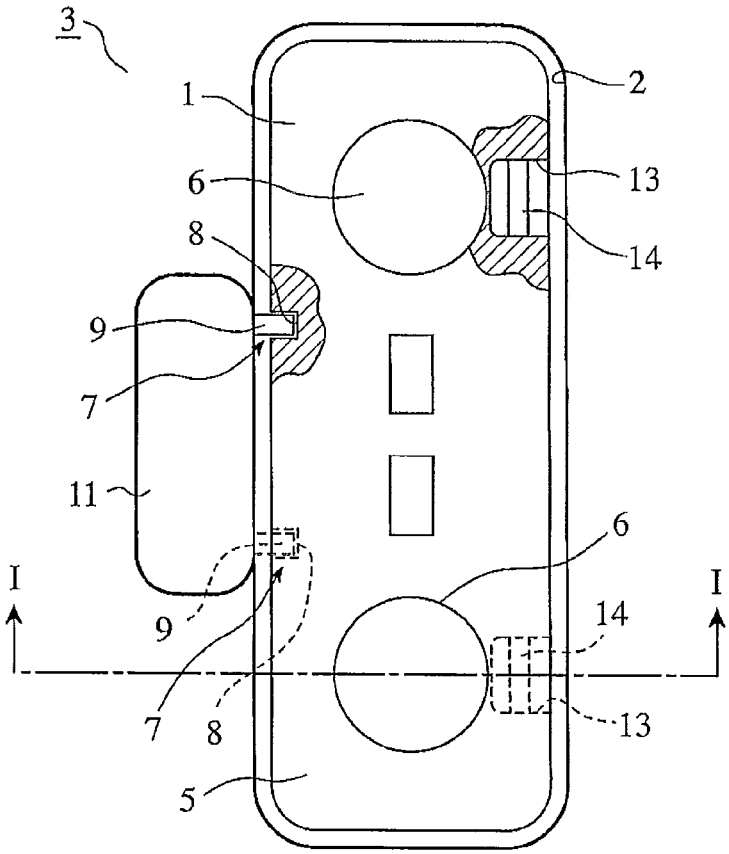
FIG. 2 is a front view of the remote control retainer in accordance with the first embodiment of the present invention.
Figure 3:
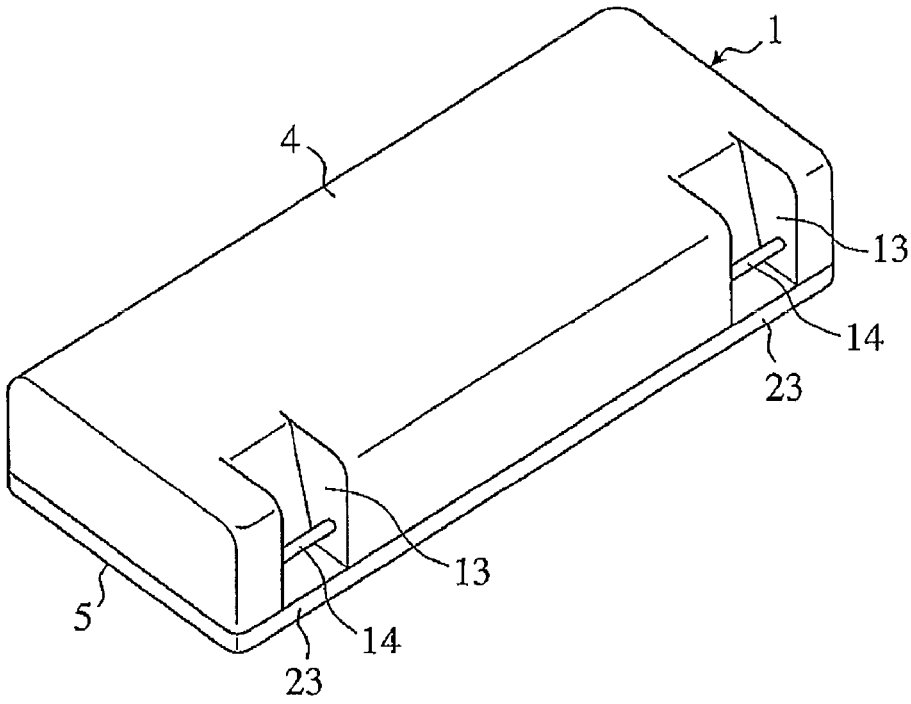
FIG. 3 is a schematic perspective view of a remote control in the remote control retainer in accordance with the first embodiment of the present invention.
Figure 4:
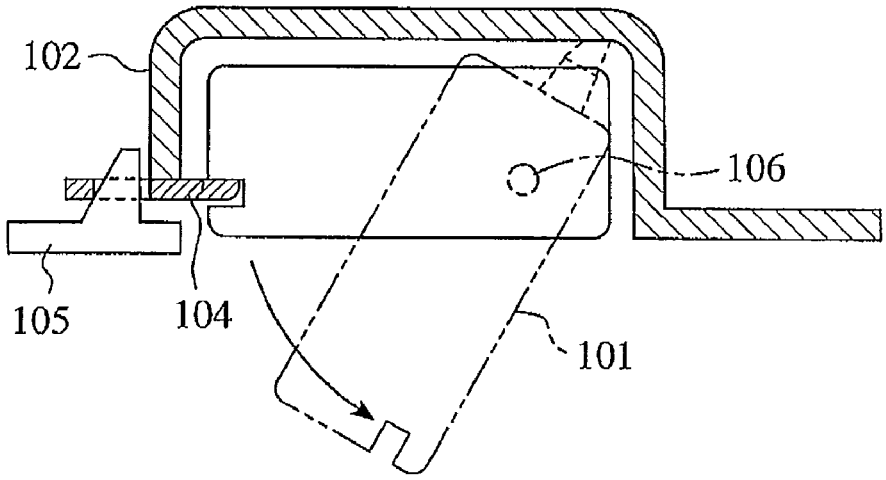
FIG. 4 is a sectional view showing one example of a conventional remote control holder.
Figure 5:
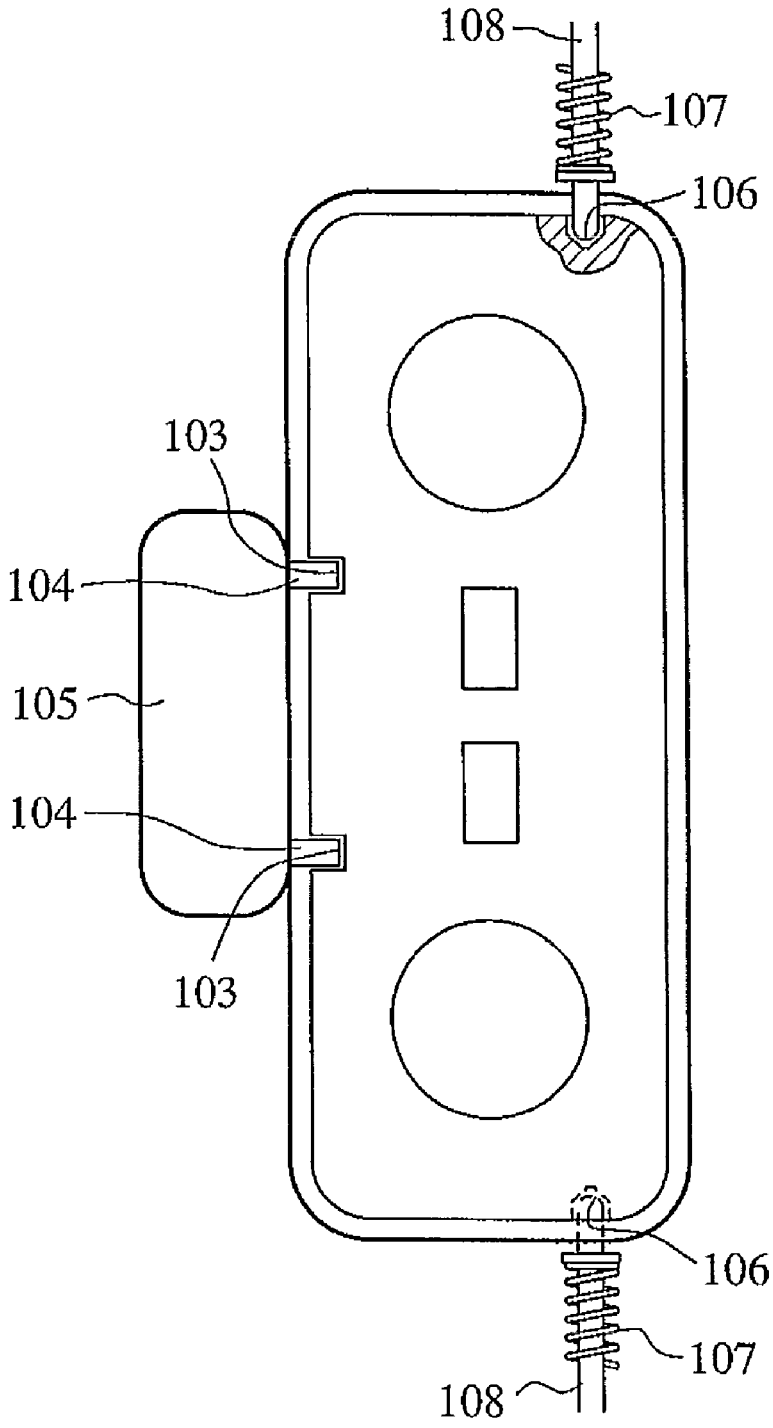
FIG. 5 is a front view of the remote control holder shown in FIG. 4.

The first embodiment of a remote control retainer in accordance with the present invention will be discussed by reference to FIGS. 1-3. FIG. 1 is a sectional view of a remote control retainer in accordance with the first embodiment, and FIG. 2 illustrates a condition viewed from the front, partially broken away, of the remote control retainer in accordance with the first embodiment. The sectional view taken along the arrowed line I-I of FIG. 2 corresponds to FIG. 1. FIG. 3 is a schematic external view of the remote control. In the first embodiment, a remote control retainer according to the present invention is applied to an apparatus assembled or incorporated to the ceiling surface of an automobile vehicle.

The apparatus built in the ceiling surface of the vehicle has provided thereon a remote control holder 3 having a concave remote control housing section 2 for housing a remote control 1. The remote control 1 consists of a box-shaped bottom cover 4 and an upper cover 5 covering the opening of the bottom cover like a lid. The bottom cover 4 has a variety of elements of the remote control assembled therein. The upper cover 5 has a variety of operating buttons 6 of the remote control provided on the outer surface thereof as shown in FIG. 2.

A locking mechanism 7 functioning as a locking means is provided between one side of the remote control 1 in the lengthwise direction and the remote control holder 3. The remote control 1 has provided in the one side thereof two locking holes 8, which are the constituent parts of the locking mechanism 7. On the other hand, at the positions corresponding to the locking holes 8, the remote control holder 3 has provided locking pins 9, which are the constituent parts of the locking mechanism 7, with a resilient force exerted toward the locking hole 8. The locking pin 9 has a hole 10 provided therethrough, and an engaging section 12 of an unlocking button 11 assembled to the remote control holder 3 is inserted into the hole 10. The engaging section 12 has a trapezoidally shaped side, and the slope thereof is engaged against the edge of the hole 10 of the locking pin 9. FIG. 1 and FIG. 2 illustrate a state where the locking pin 9 is extended into the locking hole 8 and the remote control 1 is thereby locked. When the unlocking button 11 is pushed, the locking pin 9 is moved in the direction where the locking pin becomes dislodged from the locking hole 8 by the engagement between the engaging section 12 and the hole 10, and the locking pin is extruded from the locking hole 8. Briefly, the lock is released. In this context, as not shown, the unlocking button 11 is provided with a resilient force in the thrusting back direction.

On the side of the remote control 1 opposite the side where the locking holes 8 are provided, concavities 13 at two positions are provided as shown in FIG. 3. Provided within each of the concavities 13 is a shaft 14 parallel to the longitudinal direction of the remote control 1. The shaft 14 is formed by molding unitedly with the bottom cover 4. e.g., or by embedding a metal shaft member in the bottom cover 4 upon molding.

The wall constituting the remote control housing section 2 of the remote control holder 3 has formed a bearing section 15 extending within the concavity 13 at the location corresponding to the concavity 13, when the remote control 1 is housed in the remote control housing section 2. The lower portion of the bearing section 15 constitutes a bearing 16 having an arcuate face capable of abutting on the shaft 14.

A lever bearing section 17 is provided in the proximity of the bearing section 15 on the external side of the remote control holder 3, and a shaft section 19 at the bottom end of a holding lever 18 is rotatably supported at each of the lever bearing sections 17. The shaft section 19 is disposed parallel to the shaft 14 of the remote control 1 in the state where the remote control is housed in the remote control holder 3. The holding lever 18 has provided on the remote control holder 3 side thereof an arcuate shaft holding face 20 that may abut on the shaft 14 from below. The holding lever 18 has provided about the shaft section 19 at the bottom end thereof a coil spring 21 engaged against the holding lever 18 and the external face of the remote control holder 3. The coil spring 21 energizes the holding lever 18 toward the remote control holder 3. The portion of the holding lever 18 located on the tip side of the lever from the shaft holding face 20 forms an engaging face 22 receiving the force for rotating the holding lever 18 against the resilient force of the coil spring 21. The engaging face 22 and the shaft holding face 20 are connected to each other in an angle when viewed from side.

The upper cover 5 of the remote control 1 constitutes the bottom of the concavity 13, and the edge of the cover works as a lever engaging section 23 serving the function of abutting against the engaging face 22 of the holding lever 18 to rotate the holding lever 18.

As the above, the structure of the remote control retainer in accordance with the first embodiment has been discussed. The operation of housing, holding, and taking out the remote control 1 with the remote control retainer is as follows:

FIG. 2 illustrates a state where the remote control 1 is held in the remote control retainer. The remote control 1 is locked on one side thereof by the locking mechanism 7. The remote control 1 is supported on the other side thereof with each of the shafts 14 thereof gripped between the bearing 16 of the bearing section 15 of the remote control holder 3 and the shaft holding face 20 of the holding lever 18. In other words, the shaft holding face 20 of the holding lever 18 presses the shaft 14 against the bearing 16 by the resilient force of the coil spring 21 exerted on the holding lever 18 to hold the shaft 14.

When the remote control 1 is taken out from the state, first, the unlocking button 11 is pushed to extrude the locking pin 9 from the locking hole 8 of the remote control 1, and thereby the lock is released. The remote control 1 downward rotates by the release of lock, and is stopped in such a manner that the lever engaging section 23 of the remote control 1 abuts against the engaging face 22 of the holding lever 18. The shaft 14 of the remote control 1 is gripped and supported between the bearing 16 of the bearing section 15 of the remote control holder 3 and the shaft holding face 20 of the holding lever 18, and thus the remote control 1 does not fall off even if a vehicle vibrates.

When an occupant further rotates the remote control with the remote control 1, the lever engaging section 23 of the remote control 1 presses the engaging face 22 of the holding lever 18, and the holding lever 18 is rotated by the principle of leverage against the resilient force of the coil spring 21. The holding lever 18 is rotated, and thereby the shaft holding face 20 of the holding lever 18 is moved away from the shaft 14, thus causing the remote control 1 to be easily taken out.

Note that when the remote control 1 is taken out, the holding lever 18 is rotated to the side of the bearing section 15 of the remote control holder 3 by the resilient force of the coil spring 21, then abuts and stops against the bearing section 15.

When the remote control 1 is set in the remote control holder 3, the remote control 1 only has to be inserted toward and into the remote control housing section 2 of the remote control holder 3. When the insertion of the remote control 1 into the remote control housing section 2 is continued, first, the shaft 14 abuts against the engaging face 22 of the holding lever 18, then the remote control 1 is further pressed thereinto, thereby the shaft 14 enters the area of the shaft holding face 20 over the engaging section 22, and the shaft 14 comes to be gripped and held between the bearing 16 of the bearing section 15 and the shaft holding face 20 of the holding lever 18. The shaft 14 is gripped between the bearing 16 of the bearing section 15 and the shaft holding face 20 of the holding lever 18 from above and under, and thus the remote control does not fall off.

As discussed above, the shaft 14 of the remote control 1 is held by the resilient force exerted on the holding lever 18, and released by rotating the holding lever 18 against the resilient force exerted on the holding lever 18. Thus, in order to properly hold the remote control 1 and easily take out the remote control, it is required to properly adjust the resilient force of the coil spring 21 imparting the resilient force to the holding lever 18. However, since the direction where the remote control 1 is rotated to be taken out and the direction where the holding lever 18 is rotated are the same, the adjustment of the resilient force of the coil spring 21 is easily made.

On the opposite side of the remote control 1, the side of the remote control 1 thrusts back the locking pin 9 by being pressed into the remote control housing section 2. When the locking hole 8 of the remote control 1 comes to the position of the locking pin 9, the locking pin 9 enters the locking hole 8 to lock the remote control 1.

As discussed above, according to the remote control retainer of the first embodiment, in a state where the locking mechanism 7 is released, the remote control 1 has the shaft 14 thereof gripped between the bearing 16 of the bearing section 15 of the remote control holder 3 and the shaft holding face 20 of the holding lever 18, and thus the remote control stays in a temporarily retaining state where the remote control does not fall off and is retained. Therefore, the remote control does not fall off even in the temporarily retaining state by the vibration or the like of a vehicle. When the remote control 1 is rotated from the temporarily retaining state, the lever engaging section 23 of the remote control 1 presses the engaging face 22 of the holding lever 18, and the remote control 1 can be easily taken out by a small force by means of the principle of leverage. Further, a detaching direction of the remote control 1 and a moving direction of the holding lever 18 are the same, and thus the retaining force by the holding lever 18 can be easily adjusted by adjusting the resilient force of the spring member exerted on the holding lever 18. Furthermore, in accordance with the first embodiment, the remote control 1 has the concavities 13 provided in the side thereof, and has the shaft 14 provided within each of the concavities. Thus, the members cannot project sideways from the remote control 1, and the external form of the remote control is not large or bulky.

The remote control retainer according to the present invention is not limited to the above-described first embodiment, and can be embodied in many different forms. For example, the remote control 1 does not have two shafts 14, but can have one or of course three or more shafts 14. The bearing section 15 and the holding lever 18 may be also embodied in many different forms as long as the bearing section and the holding lever have a form performing the functions of gripping and holding the shaft 14.

INDUSTRIAL APPLICABILITY

As discussed above, the remote control retainer according to the present invention is suitable for use, e.g., in an appliance assembled to the ceiling of a vehicle where vibration is generated because the shaft of the remote control is gripped between the bearing section and the holding lever of the remote control holder, the remote control, when the lock is released, does not fall off and is held, and further, the remote control is arranged to be detached by rotating the remote control in the same direction as the moving one of the holding lever.

The invention claimed is:

1. A remote control retainer retaining a remote control housed in a remote control holder, the retainer comprising: a locking mechanism which is provided between one side of the remote control and the remote control holder, and locks or unlocks the remote control with respect to the remote control holder; a shaft provided in the remote control on the opposite side of the side provided with the locking means; a bearing section which is provided on the side of the remote control holder and against which the shaft is abutted when the remote control is housed in the remote control holder; a lever gripping the shaft in cooperation with the bearing section; a spring member providing a holding force with which the shaft is pressed to the side of the bearing section to be held thereon to the lever; and a lever engaging section which is provided on the remote control, and when the locking means is released to rotate the remote control about the shaft, engages with the lever to rotate the lever against the resilient force of the spring member, thus moving the lever away from the shaft.

2. The remote control retainer according to claim 1, wherein a concavity is formed on the opposite side of the side provided with the locking means, and the shaft is formed within the concavity.

* * * * *